United States Patent [19]

Tsukuda et al.

[11] Patent Number: 5,013,485

[45] Date of Patent: May 7, 1991

[54] LIQUID DETERGENT COMPOSITION CONTAINING TERPENE AND CALCIUM OR MAGNESIUM SALTS

[75] Inventors: Kazunori Tsukuda; Masakazu Toda, both of Utsunomiya; Masami Saito, Ichikai; Masaki Tsumadori, Utsunomiya, all of Japan

[73] Assignee: Kao Corporation, Tokyo, Japan

[21] Appl. No.: 373,278

[22] Filed: Jun. 28, 1989

[30] Foreign Application Priority Data

Jul. 19, 1988 [JP] Japan ..... 63-177996

[51] Int. Cl.[5] ..... C11D 1/12; C11D 3/04; C11D 3/18

[52] U.S. Cl. ..... 252/551; 252/550; 252/554; 252/162; 252/558

[58] Field of Search ..... 252/106, 107, 111, 114, 252/118, 122, 139, 153, 162, 170, 171, 545, 546, 540, 551, 550, 554

[56] References Cited

U.S. PATENT DOCUMENTS 4,414,128 11/1983 Goffinet ..... 252/111

*Primary Examiner*—Prince E. Willis
*Assistant Examiner*—John F. McNally
*Attorney, Agent, or Firm*—Oblon, Spivak, McClelland, Maier & Neustadt

[57] ABSTRACT

A liquid detergent composition for household use is disclosed. It comprises, as essential components, (A) 0.01–1.0% by weight of an anionic surface active agent, (B) 0.01–1.0% by weight of a terpene-type hydrocarbon solvent selected from monoterpenes and sesquiterpenes, and (C) 0.001–0.1% by weight of a water-soluble divalent metallic salt. The composition has superior detergency, exhibits a minimum adverse effect on surfaces which it contacts and a high degree of safety when in contact with the human body, and does not require rinsing.

7 Claims, No Drawings

LIQUID DETERGENT COMPOSITION CONTAINING TERPENE AND CALCIUM OR MAGNESIUM SALTS

BACKGROUND OF THE INVENTION

1. Field of the Invention

The present invention relates to a liquid detergent composition, and, in particular, to a liquid detergent composition for household use having superior detergency, as well as exhibiting a minimum adverse effect on surfaces which it contacts, a high degree of safety when in contact with the human body, and which does not require rinsing.

2. Description of the Background

In general, when a prolonged period of time elapses after a solid surface gets soiled, washing becomes difficult because the soiling material adheres strongly to the surface. For example, in the case where dirt adhering to exhaust fan blades, walls in the kitchen area, glass, refrigerator surfaces, and the like has accumulated over a long period of time, this dirt changes to a highly viscous, oxidized form of degenerated oils. In addition, difficult-to-clean, oily-type soiling, such as that from hand stains, cigarette tars, and the like exists throughout the household in locations other than the kitchen area.

Commonly known detergents for removing such oily-type soiling include those containing a strong alkaline agent such as sodium hydroxide or the like, as a major component, and those containing an organic amine, a water-soluble organic solvent (such as ethylene glycol monoalkyl ether, diethylene glycol monoalkyl ether, or the like), and a surface active agent.

However, the former type presents a safety problem, especially with respect to skin irritation, while the latter type gives rise to discomfort because of having an offensive odor of the organic solvent.

Detergents containing monoterpenes and sesquiterpenes have been proposed as detergents with a high degree of safety and without an offensive odor of organic solvents (Japanese Patent Laid-open Nos. 14296/1986, 14297/1986, and 164798/1987). Although they have high detergency performance, their handling is sometimes cumbersome upon practical use. For example, they must be diluted with water before use, or rinsed off with water after being used in the original liquid form. This problem is caused by abrasive powders contained in the detergent or surface active agents contained in the emulsion type detergents.

SUMMARY OF THE INVENTION

The present inventors conducted extensive studies to provide, with due consideration to the drawbacks of such conventional detergents, a liquid detergent composition for household use having superior detergency, exhibiting a minimum adverse effect on surfaces which it contacts, and a high degree of safety when in contact with the human body, and which does not require rinsing, and found that a liquid detergent composition which comprises an anionic surface active agent, a terpene-type hydrocarbon selected from monoterpenes and sesquiterpenes, and a water-soluble divalent metal salt, did not require dilution prior to use, nor an after-rinse, had a high degree of safety, and easily removed soiling.

Accordingly, an object of the present invention is to provide a liquid detergent composition comprising as essential components:

(A) 0.01–1.0% by weight of an anionic surface active agents, (B) 0.01–1.0% by weight of a terpene-type hydrocarbon solvent selected from monoterpenes and sesquiterpenes, and (C) 0.001–0.1% by weight of a water-soluble divalent metal salt.

Other objects, features and advantages of the invention will hereinafter become more readily apparent from the following description.

DETAILED DESCRIPTION OF THE INVENTION AND PREFERRED EMBODIMENTS

Examples of the anionic surface active agent used as the component (A) in the present invention include sulfonate-type anionic surface active agents and sulfate-type anionic surface active agents commonly used in detergent compositions. The sulfonate-type anionic surface active agents include linear or branched alkyl ($C_8$–$C_{23}$) benzene sulfonates, long chain alkyl ($C_8$–$C_{22}$) sulfonates, and long chain olefin ($C_8$–$C_{22}$) sulfonates. Examples of sulfate-type anionic surface active agents include long chain monoalkyl ($C_8$–$C_{22}$) sulfates, polyoxyethylene (1–6 mols) long chain alkyl ($C_8$–$C_{22}$) ether sulfates, polyoxyethylene (1–6 mols) alkyl ($C_8$–$C_{18}$) phenylether sulfates, and the like. As counter ions to these anionic surface active agents, examples which can be given are alkali metal ions such as sodium, potassium, and the like, and alkanolamine ions such as monoethanolamine, diethanolamine, triethanolamine, and the like.

Among the above anionic surface active agents the sulfonate-type anionic surface active agents are particularly desirable as the (A) component of the present invention from the aspect of high resistance to hydrolysis. In addition, linear or branched alkylbenzene sulfonates are desirable from the aspect of high detergency.

The (A) component anionic surface active agents may be used individually or as a mixture of two or more types in the composition of the present invention.

The amount of the (A) component as a percentage by weight (hereinafter referred to as wt %) of the total composition is in the range of 0.01 to 1.0 wt %; a particularly desirable amount is in the range of 0.1 to 0.5 wt %. If the amount is less than 0.01 wt % of the mixture, the surface active agent exhibits insufficient emulsifying and dispersion action and the solubilizing activity is inadequate; if greater than 1.0 wt %, it leaves wiping traces on the surface of the washed object after wiping, which needs an undesirable rinsing step.

The component (B) of the composition of the present invention is a terpene-type hydrocarbon solvent selected from monoterpenes and sesquiterpenes. Examples of monoterpene-type hydrocarbon solvents are D-limonene and L-limonene which are contained in orange oil, lemon oil, or the like, $\alpha$-terpineol contained in pine oil or the like, and $\alpha$-pinene, $\beta$-pinene, myrcene, and p-cymene contained in turpentine oil or the like. Examples of sesquiterpene-type hydrocarbon solvents which can be given are caryophyllene, cedrene, and the like, which are contained in substantial quantities in cedar oil, clover oil, cananga oil, and the like.

The (B) component which is a terpene-type hydrocarbon solvent selected from monoterpenes and sesquiterpenes may be used individually or as a mixture of two or more types in the composition of the present invention. In addition, it is possible to incorporate their starting materials of orange oil, turpentine oil, or pine oil as they are into the composition of the present invention.

A desirable amount of the (B) component as a percentage of the total composition is in the range of 0.01 to 1.0 wt %; a particularly desirable amount is in the range of 0.1 to 0.5 wt %. If the amount is less than 0.01 wt % of the composition, action as a solvent cannot be expected; if greater than 1.0 wt %, a large amount of a surface active agent is necessary to ensure stable solubilization of the compound. Because remnants remain on the surface of the washed object they must be rinsed and wiped a second time, which is undesirable.

Water-soluble divalent metal salts which are suitable as the component (C) of the composition of the present invention are, for example, calcium salts and magnesium salts. Of the calcium salts, the chloride and the sulfate are particularly desirable; for the magnesium salts, the sulfate is best used.

A desirable amount of the (C) component in a percentage of the total composition is in the range of 0.001 to 0.1 wt %. The HLB value of the component (A) of the present invention can be freely adjusted corresponding to the amount of the component (C) added. Addition of the component (C) also assists to solubilize the component (B).

In addition, as required, components other than the essential components (A), (B), and (C) can be added to the liquid detergent composition of the present invention. These optional components include nonionic surface active agents, alkaline agents, dispersing agents, solvents, acids, perfumes, dyes, pigments, preservatives, germicides, and the like.

Other features of the invention will become apparent in the course of the following description of the exemplary embodiments which are given for illustration of the invention and are not intended to be limiting thereof.

EXAMPLES

Example 1

Detergent compositions listed in the following Table 1 were prepared and actually used to wash a household window glass. The detergency, wiping traces, and solvent odor were then evaluated.

The object window glass was sprayed with 1 cc of a liquid detergent using a commercial sprayer, and wiped with a dry towel. Sensory evaluations were then carried out, using the following evaluation criteria.

Evaluation Criteria

Detergency
- O: 80% of soiling is removed
- F: 20 to 50% of soiling is removed
- X: Almost no soiling removed Wiping traces
- O: Second wiping not necessary
- F: Slight wiping traces remaining
- X: Considerable wiping traces observed Solvent odor
- O: No objectionable odor detected
- F: Slight objectionable odor
- X: Objectionable odor noted The results are shown in Table 1.

TABLE 1

| Components | (wt %) 1 | 2 | 3 | 4 | 5 | 6* | 7* |
|---|---|---|---|---|---|---|---|
| Sodium alkylbenzene sulfonate(1) | 0.5 | 0.5 | 0.3 | 0.3 | 1.5 | 0.2 | 0.3 |
| Polyoxyethylenealkyl-ether(2) | — | — | — | 0.2 | — | 0.1 | — |
| D-limonene | — | — | 0.3 | — | 0.5 | 0.3 | — |
| α-Pinene | — | — | — | 0.5 | — | — | 0.5 |
| Ethyl cellosolve | 1.0 | — | — | — | — | — | — |
| Butyl carbitol | — | 1.0 | — | — | — | — | — |
| Calcium chloride | — | — | — | — | 0.01 | 0.01 | 0.01 |
| Ion exchanged water | Balance | Balance | Balance | Balance | Balance | Balance | Balance |
| Detergency | O | O | F | F | O | O | O |
| Wiping traces | O | F | F | F | X | O | O |
| Solvent odor | X | F | O | O | O | O | O |

*Compositions of the present invention
(1) An average cabon number in alkyl chain: $C_{12}$
(2) An average cabon number in alkyl chain: $C_{12}$. An average ethylene oxide addition mols: 6

Example 2

Detergent compositions listed in the following Table 2 were prepared, and the detergency and wiping traces were evaluated using soiled models.

Soiled models used were 3 cm×8 cm glass plates to which cigarette tars were adhered. The glass plates were immersed in test solutions for 2 minutes and the elimination of the soiling was evaluated to determine the detergency according to the following criteria. The glass plates were wiped with dry towel and the completeness after drying was sensorially evaluated according to the following criteria to determine wiping traces.

Detergency
- O: 80% of soiling is removed
- F: 20 to 50% of soiling is removed
- X: Almost no soiling removed Wiping traces
- O: Second wiping not necessary
- F: Slight wiping traces remaining
- X: Considerable wiping traces observed Results are shown in Table 2.

TABLE 2

| Components | (wt %) 8* | 9* | 10* | 11* | 12* | 13 | 14 | 15 |
|---|---|---|---|---|---|---|---|---|
| Sodium alkylbenzene solfonate(1) | 0.3 | 0.3 | 0.3 | 0.3 | 0.5 | 0.3 | 0.3 | 2.5 |
| Polyoxyethylenealkyl- | 0.1 | 0.1 | 0.1 | 0.1 | 0.5 | 0.1 | 0.1 | 2.5 |

TABLE 2-continued

| Components | (wt %) | | | | | | | |
|---|---|---|---|---|---|---|---|---|
| | 8* | 9* | 10* | 11* | 12* | 13 | 14 | 15 |
| ether(2) | | | | | | | | |
| Orange oil (Major component: D-limonene) | 0.5 | — | — | — | 1.0 | — | — | 10.0 |
| Turpentine oil (Major component: α, β-pinene) | — | 0.5 | — | — | — | — | — | — |
| Cananga oil (Major component: α, β-caryophyllene) | — | — | 0.5 | — | — | — | — | — |
| α-terpineol | — | — | — | 0.5 | — | — | — | — |
| Butyl carbitol | — | — | — | — | — | 3.0 | — | — |
| Ethanol | — | — | — | — | — | — | 10.0 | — |
| Diethanolamine | 0.5 | 0.5 | 0.5 | 0.5 | 0.1 | 0.5 | 0.5 | 0.1 |
| Calcium chloride | 0.01 | 0.01 | 0.01 | 0.01 | 0.01 | — | — | — |
| Ion exchanged water | Balance | Balance | Balance | Balance | Balance | Balance | Balance | Balance |
| Detergency | O | O | O | O | O | O | F | O |
| Wiping traces | O | O | O | O | O | F | O | X |

*Compositions of the present invention
(1) An average cabon number in alkyl chain: $C_{12}$
(2) An average cabon number in alkyl chain: $C_{12}$, An average ethylene oxide addition mols: 6

Obviously, numerous modifications and variations of the present invention are possible in light of the above teachings. It is therefore to be understood that within the scope of the appended claims, the invention may be practiced otherwise than as specifically described herein.

What is claimed is:

1. A liquid detergent composition comprising as essential components:

(A) 0.01–1.0% by weight of an anionic surface active agent, (B) 0.01–1.0% by weight of a terpene hydrocarbon solvent selected from monoterpenes and sesqueterpenes; and (C) 0.001–0.1% by weight of a water-soluble divalent metallic salt selected from the group consisting of $CaCl_2$, $CaSO_4$ and $MgSO_4$.

2. The liquid detergent composition of claim 1, wherein the anionic surface active agent is selected from the group consisting of the linear or branched alkyl $C_8$–$C_{23}$ benzene sulfonates, long chain alkyl $C_8$–$C_{22}$ sulfonates, long chain olefin $C_8$–$C_{22}$ sulfonates, long chain monoalkyl $C_8$–$C_{22}$ sulfates, polyoxyethylene (1–6 mol) long chain alkyl $C_8$–$C_{22}$ ether sulfates and polyoxyethylene (1–6 mols) alkyl $C_8$–$C_{18}$ phenylether sulfates or mixtures thereof.

3. The liquid detergent composition of claim 1, wherein the anionic surface active agent is present in from 0.1–0.5% by weight.

4. The liquid detergent composition of claim 1, wherein the terpene hydrocarbon solvent is selected from the group consisting of D-limonene, L-limonen, orange oil, lemon oil, α-terpineol, pine oil, α-pinene, β-pinene, myrcene, p-cymene, terpentine oil, caryophyllene, cedrene, cedar oil, clover oil, and cananga oil or mixtures thereof.

5. The liquid detergent composition of claim 1, wherein the terpene hydrocarbon is present in from 0.1–0.5% by weight.

6. The liquid detergent composition of claim 1, wherein the counterion of the anionic surface active agent is selected from the group consisting of alkali metal ions, alkanolamine ions.

7. The liquid detergent composition of claim 1, wherein the anionic surface active agent is a linear or branched alkyl benzene sulfonate.

* * * * *